US005404675A

United States Patent [19]

Schmidhauser

[11] Patent Number: 5,404,675

[45] Date of Patent: Apr. 11, 1995

[54] ASSEMBLY FOR MOVABLY SUSPENDING PANELS FROM OVERHEAD SUPPORTS

[75] Inventor: Heinz Schmidhauser, Zihlschlacht, Switzerland

[73] Assignee: Eku AG, Uzwil, Switzerland

[21] Appl. No.: 26,600

[22] Filed: Mar. 5, 1993

[30] Foreign Application Priority Data

Mar. 6, 1992 [CH] Switzerland ..... 00733/92
Oct. 13, 1992 [CH] Switzerland ..... 03201-/92

[51] Int. Cl.[6] ..... E05D 13/00
[52] U.S. Cl. ..... 49/409; 16/87.4
[58] Field of Search ..... 49/404, 409, 410, 411, 49/412, 425; 16/87.4, 91, 106; 160/345, 346, 347

[56] References Cited

U.S. PATENT DOCUMENTS

| | | | |
|---|---|---|---|
| 699,971 | 5/1902 | Poschmann | 16/87.4 |
| 1,610,282 | 12/1926 | Hansen | 49/410 |
| 2,230,615 | 2/1941 | Dick | 49/409 |
| 3,155,149 | 11/1964 | Ford | 160/346 |
| 3,457,676 | 7/1969 | Ziegler | 49/409 |
| 3,457,677 | 7/1969 | Zeigler | 49/409 |
| 3,471,891 | 10/1969 | Hachtel | 16/87.4 |
| 3,529,316 | 9/1970 | Hachtez | 160/345 |
| 3,808,633 | 5/1974 | Lauterbach | 49/409 |
| 4,872,287 | 10/1989 | Block | 49/409 |
| 5,189,758 | 3/1993 | Levy | 49/409 |

FOREIGN PATENT DOCUMENTS

| | | | |
|---|---|---|---|
| 487956 | 6/1992 | European Pat. Off. | 49/409 |
| 2034024 | 12/1970 | France | 49/409 |
| 1259059 | 1/1968 | Germany | 16/87.4 |
| 1259062 | 1/1968 | Germany | 16/87.4 |
| 1269309 | 5/1968 | Germany | 16/87.4 |
| 1097324 | 1/1968 | United Kingdom | 49/409 |

*Primary Examiner*—Michael J. Milano
*Attorney, Agent, or Firm*—Darby & Darby

[57] ABSTRACT

The upper portion of a panel can be slidably suspended in an elongated guide rail at the underside of an elongated support by connecting the upper portion of the panel with two spaced-apart carriers each of which is provided with an upwardly extending follower including one or more pairs of rollers extending into the interior of the rail from below. The carriers can be separably attached to and are then turnable in bearings which are recessed into the upper portion of the panel, or each carrier can be provided with an anchoring device having one or more knives which penetrate into the material of the panel when a main portion of a carrier is received in a recess of the panel and the anchoring device is thereupon turned relative to its carrier. The overhead support can be provided with clips which releasably hold the panel in either of two end positions and/or with stops which can arrest the panel in a preselected end position relative to the guide rail.

20 Claims, 4 Drawing Sheets

ASSEMBLY FOR MOVABLY SUSPENDING PANELS FROM OVERHEAD SUPPORTS

BACKGROUND OF THE INVENTION

The invention relates to improvements in assemblies for movably securing doors, partitions or like parts to overhead frames, walls or other supports. More particularly, the invention relates to improvements in assemblies which can be utilized with advantage to movably suspend door panels or like parts in door frames, from ceilings or from like supports.

It is well known to mount a door panel for reciprocatory (rather than pivotal) movement in a kitchen cabinet, in a filing cabinet, in a door frame, in a built-in closet or the like. As a rule, a guide rail is recessed into or embedded in a support (such as a plate, wall, frame member or the like) above the opening which is to be exposed or closed by a reciprocable panel, and the top portion of the panel carries one or more slidable parts (e.g., in the form of runners) which extend into the guide rail from below and confine the panel to reciprocatory movements longitudinally of the rail. A runner is preferably selected in such a way that the friction between its external surface and the guide rail can be readily overcome without the exercise of a substantial effort. The desirability of such mounting will be readily appreciated by bearing in mind that the reciprocable panel of a kitchen cabinet, filing cabinet, door or closet must be reciprocated or is likely to require movement to open or closed position at frequent intervals. Friction between the slidable panel and the guide rail can rise to an undesirably high value if the panel is rather large and heavy.

Attempts to overcome the just discussed drawbacks of conventional assemblies for reciprocably suspending slidable panels from their supports include the provision of roller followers which are caused to extend into the guide rail and reduce friction when a relatively heavy and bulky panel is to be pushed or pulled between open and closed positions. Such roller followers are used in assemblies for the mounting of heavy outdoor panels which are to expose or close large openings in masonry walls and the like. It is not customary to employ roller followers indoors (e.g., in pieces of furniture) because experts in the relevant field share the opinion that an assembly which employs roller followers occupies too much space above the reciprocable panel.

Published German patent application Serial No. 22 06 447 discloses an assembly wherein a guide rail receives two pairs of rollers. The rollers of each pair are rotatable about a common horizontal axis, and such pairs of rollers are mounted on a carrier which, in turn, can swivel about a vertical axis.

Published German patent application Serial No. 19 60 037 discloses an assembly wherein a runner which extends into an overhead guide rail is provided with a substantially button-shaped downwardly extending enlargement which is anchored in the top portion of the reciprocable panel. The runner is held against lateral movements by extending into a substantially semicylindrical recess.

A drawback of the aforedescribed conventional assemblies is that they are expensive and that their installation in a reciprocable panel and in an overhead support takes up much time. Furthermore, presently known assemblies for indoor use cannot support relatively heavy slidable panels, e.g., doors weighing between 20 and 30 kg.

OBJECTS OF THE INVENTION

An object of the invention is to provide an assembly which can reliably support heavy or lightweight slidable panels.

Another object of the invention is to provide the assembly with novel and improved means for securing certain of its parts to a slidable panel.

A further object of the invention is to provide an assembly which, in reliably suspending a reciprocable door or the like from an overhead support, can also perform one or more additional desirable and important functions.

An additional object of the invention is to provide an assembly which can automatically arrest the slidable part or parts in one or more selected positions.

Still another object of the invention is to provide an assembly which can releasably hold a slidable part in one or more selected positions.

A further object of the invention is to provide an assembly which can be installed and/or dismantled with little loss in time and by resorting to simple and readily available equipment.

Another object of the invention is to provide an assembly which can be at least substantially concealed when properly installed to couple a reciprocable panel or the like to an overhead support.

An additional object of the invention is to provide an assembly which can be more or less permanently or readily separably installed in a slidable panel and a door frame, cabinet frame, window frame or the like.

Still another object of the invention is to provide a novel and improved method of installing the above outlined assembly between an overhead support and a slidable door or the like.

A further object of the invention is to provide a cabinet, a door, a piece of furniture or the like which is equipped with one or more assemblies of the above outlined character.

Another object of the invention is to provide novel and improved parts to be borne by a slidable panel and are intended to slidably couple such panel to an overhead rail or the like.

An additional object of the invention is to provide a versatile assembly for reciprocably suspending panels from overhead supports.

SUMMARY OF THE INVENTION

The invention is embodied in an assembly for movably coupling an upper portion of a panel (such as a slidable door panel, partition or the like) in suspended position to an elongated guide rail in an overhead support (such as the top wall of a door frame or the top wall of a built-in closet). The improved assembly comprises a preferably substantially disc-shaped carrier, means for securing the carrier to the upper portion of a panel, a runner which extends from and is secured to the carrier (the runner can extend substantially radially outwardly of a substantially disc-shaped carrier), and a rotary follower mounted on the runner and receivable in the guide rail of a support. The guide rail preferably is or can be of the type having an elongated groove and an elongated slot which affords access to the groove from below. The runner which is to move longitudinally of such guide rail can include an extension serving to extend into the groove from below through the slot of the guide rail. The follower preferably includes at least one pair of rollers which are mounted on the extension and are receivable in the groove of the guide rail.

In accordance with one presently preferred embodiment of the invention, the follower comprises a plurality of pairs of coaxial rollers. The securing means can comprise a bearing which is receivable in a recess of the upper portion of the panel and the carrier is turnable in the bearing about a predetermined axis which is or can be horizontal when the panel is suspended from a support. The follower can comprise at least one pair of rollers which are turnable about axes extending in at least substantial parallelism with the predetermined axis.

In order to facilitate mounting of the follower in the runner, the rollers of each pair of rollers can be rotatable about a common axis and the follower further comprises a discrete shaft for each pair of coaxial rollers. The runner can be provided with a through hole having a relatively large first portion which is dimensioned to permit passage of one roller of a pair of coaxial rollers, and a second portion which is dimensioned to snugly receive the shaft between the rollers and communicates with the first portion. Such hole can further include a third portion which can be called a neck portion and connects the first and second portions. The width of the third portion should be sufficient to permit sidewise (transverse) movements of the shaft between the first and second portions of the hole.

If the securing means includes a bearing which is at least partially recessed into or is otherwise affixed to the panel, the carrier can be designed in such a way that it is turnable in the bearing. Such carrier and bearing can be provided with complementary male and female detents including means for releasably retaining the carrier in the bearing. The retaining means can comprise at least one tongue or another projection on the carrier or on the bearing and at least one groove arranged to receive the at least one projection and provided in the bearing or in the carrier.

The securing means which includes the aforementioned bearing can further comprise a collar which serves to overlie one side of the panel adjacent a recess for the bearing. One or more screws and/or other suitable fastening means can be provided to preferably releasably fasten the collar to the panel.

If the carrier is directly receivable in a recess of the panel (i.e., if the aforementioned bearing is omitted), the securing means can include means for anchoring the carrier in the panel. Such anchoring means can be movably secured to the carrier and can be provided with at least one cutting edge which serves to penetrate into the panel in response to movement of the anchoring means relative to the carrier. For example, the anchoring means can comprise a substantially L-shaped (e.g., a boomerang-shaped) member which is turnably mounted on the carrier. Alternatively, the anchoring means can comprise a substantially segment-shaped member which is turnable or otherwise movable relative to the carrier.

The assembly can further comprise at least one cleaning implement (e.g., a brush, a strip or the like) which is provided on the runner to sweep foreign matter off the guide rail in response to movement of the follower within and longitudinally of the rail.

The guide rail and/or the support can carry at least one stop (e.g., a stop at each end of the guide rail), and the runner then includes at least one abutment which serves to impinge upon and to be arrested by a stop on the support or on the guide rail in response to movement of the runner to a predetermined position relative to the guide rail. Such runner can be provided with at least one arm which is oriented in such a way that it extends in substantial parallelism with the guide rail when the panel is properly suspended from the support; the aforementioned abutment can be provided on such arm of the runner. The arm can be provided with a cam face which is engageable by a catch provided on the support and serving to engage and releasably hold the runner in a predetermined position, e.g., in a position in which an abutment of the arm contacts or is at least closely adjacent a stop on the support or guide rail. The catch can be designed to engage and releasably hold any other part of the improved assembly and/or the panel when the latter reaches a predetermined position relative to the support. The person in charge of shifting the panel must overcome the resistance which the catch offers to movement of the panel from the predetermined position in which the catch releasably holds the panel or an element of that part of the assembly which is mounted on the panel.

The novel features which are considered as characteristic of the invention are set forth in particular in the appended claims. The improved assembly itself, however, both as to its construction and the mode of installing the same, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
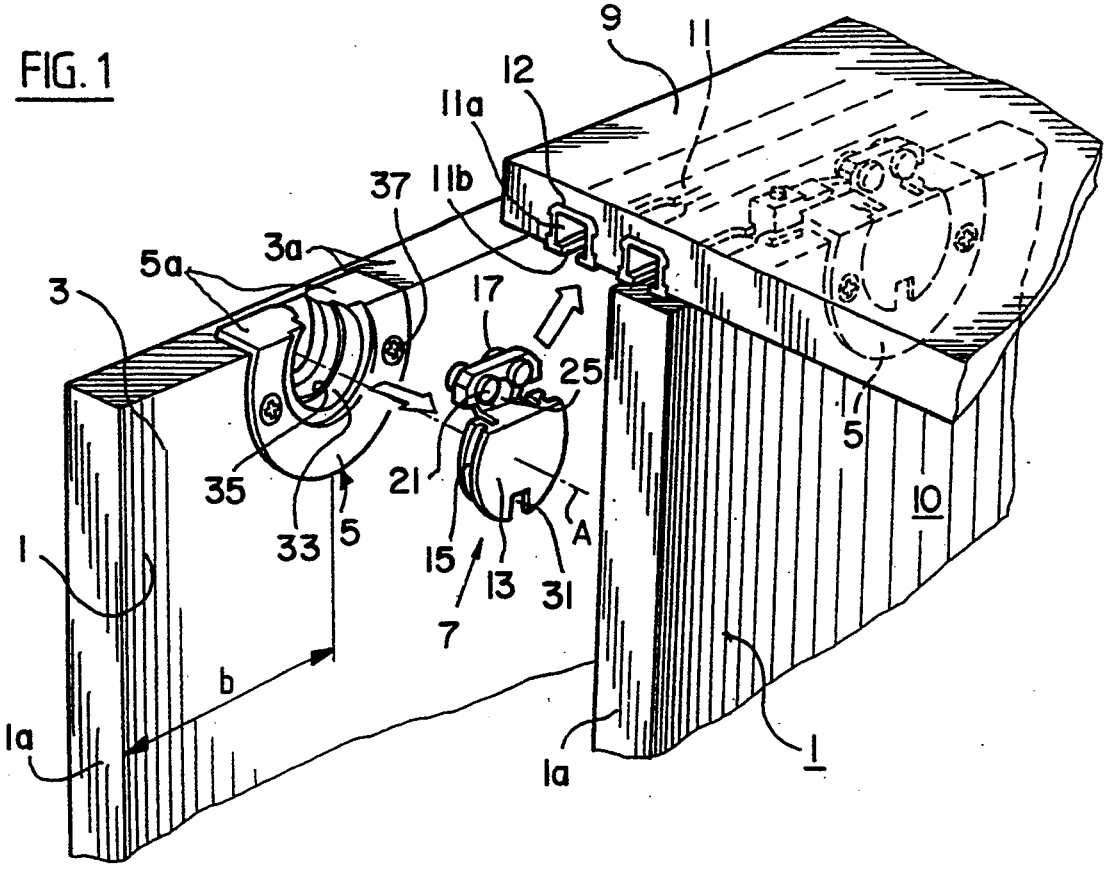
FIG. 1 is a fragmentary perspective view of two slidable panels which are suspended from a common overhead support, the assembly for coupling one of the panels to the support being shown in an exploded perspective view.

Referring first to FIGS. 1 to 4, there is shown an assembly which serves to slidably couple the upper portions 3 of two spaced-apart parallel panels 1 to an overhead support 9. The support 9 can constitute the top wall in a built-in closet or the top wall of a kitchen cabinet, a filing cabinet or any other piece 10 of furniture. The panels 1 then constitute sliding doors which can be moved along predetermined paths between open or partly open and closed positions. The panels 1 and the overhead support 9 are assumed to be made of wood; however, it is clear that such parts can also be made of a metallic, plastic or any other suitable material.

The improved assembly comprises for each panel 1 a carrier 7 having a substantially disc-shaped main portion 13 and a substantially triangular extension 17 (hereinafter called runner for short) which extends substantially radially of and from the main portion 13 and mounts a follower 19 including two pairs of coaxial rollers 21 and two shafts 23, one for each pair of rollers 21. The two pairs of rollers 21, the respective shafts 23 and at least that portion of the runner 17 which mounts the shafts 23 extend into an elongated guide rail 11 which is shown as being recessed into the underside of the support 9. The rail 11 has an elongated groove **11*a* which is accessible from below through an elongated slot 11*b* between two elongated internal surfaces 29 of the rail. The rollers 21 roll along the respective internal surfaces 29 when a panel 1 is caused to slide relative to the support 9 whereby the rollers 21 reduce friction and thus enable even a weak or infirm person to push or pull a panel 1** to a selected (open, partly open or closed) position.

Figure 2:
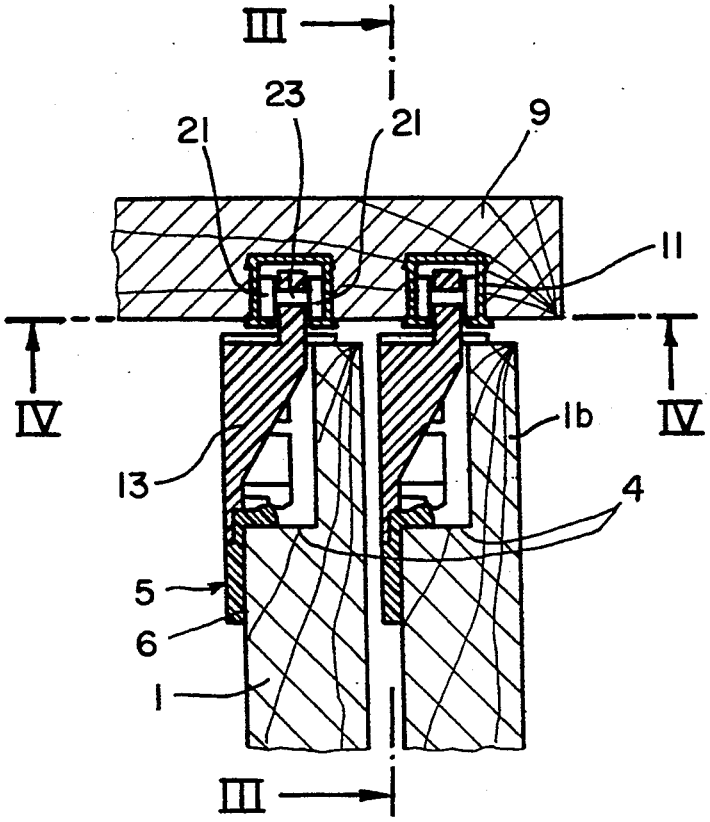
FIG. 2 is an enlarged fragmentary transverse vertical sectional view of the structure which is shown in FIG. 1, with each of the two illustrated carriers properly coupled to the respective guide rail in the overhead support.
Figure 3:
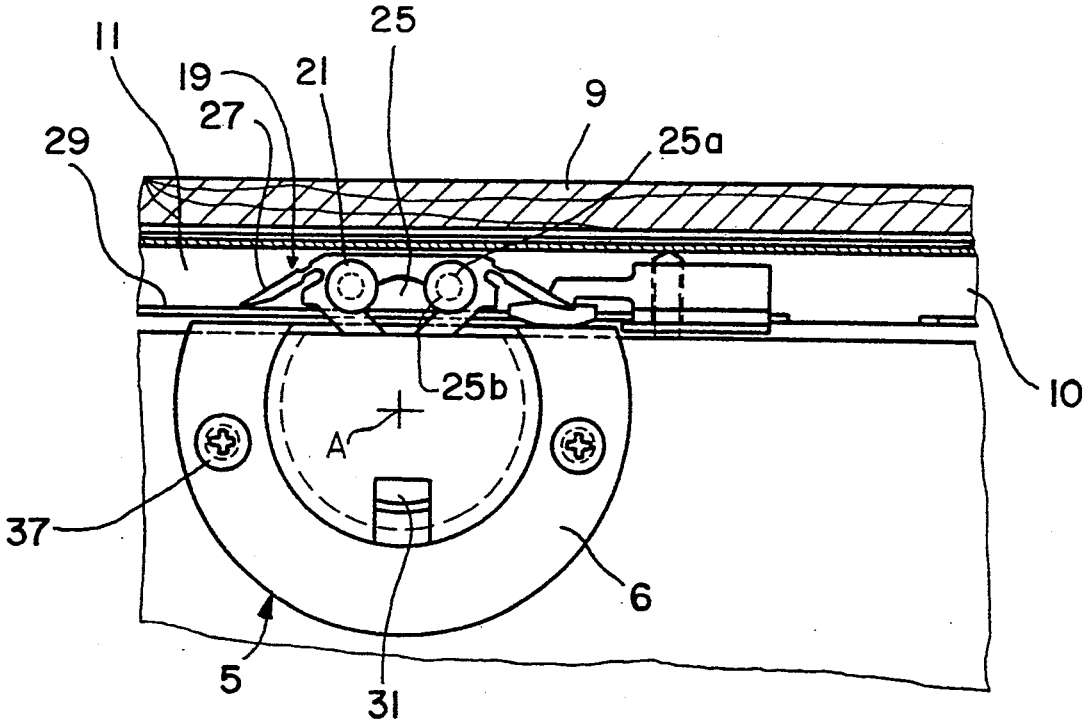
FIG. 3 is a vertical sectional view as seen in the direction of arrows from the line III—III in FIG. 2, with the slidable panel omitted.
Figure 4:
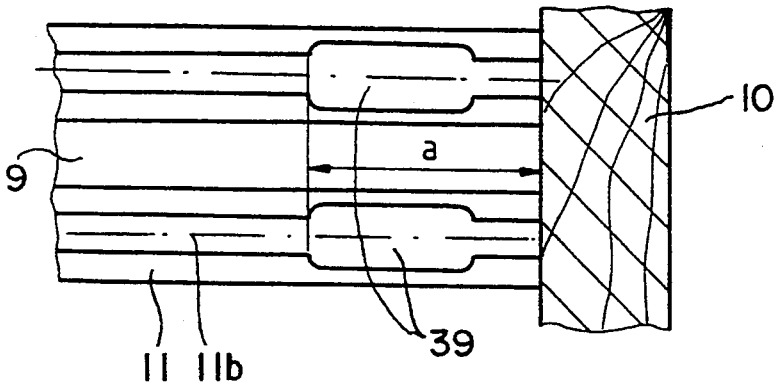
FIG. 4 is an enlarged fragmentary horizontal sectional view substantially as seen in the direction of arrows from the line IV—IV in FIG. 3.

Each panel 1 has at least two recesses 4 (FIG. 2 shows one recess 4 in each of the two panels 1) for securing means in the form of bearings 5. Each bearing includes a part cylindrical portion or socket in the respective recess 4 and a collar 6 which overlies the adjacent side of the upper portion 3 of the respective panel 1 and is affixed to such panel by at least one threaded fastener 37, e.g., a standard screw. The main portions 13 of the carriers 7 are mounted in the respective bearings 5 with at least some freedom of angular movement about a horizontal axis A which is parallel to the axes of the rollers 21. The manner in which the shafts 23 of the follower 19 (further including the two pairs of rollers 21) can be installed in the runner 17 of the corresponding carrier 7 is shown in FIG. 3. Thus, the follower 19 has a composite hole having a substantially circular main or first portion 25 serving to permit passage of one roller 21 of a pair of coaxial rollers, a second portion **25*a* serving to snugly receive that portion of a shaft 23 which extends between the respective rollers 21, and a third portion or neck portion 25*b* which establishes communication between the portions 25, 25*a* and enables a shaft 23 to move sideways (i.e., transversely of its axis) from the second portion 25*a* into the first portion 25 or in the opposite direction. The hole which is shown in FIG. 4 comprises a single first portion 25, two second portions 25*a* and two third portions or neck portions 25*b* because the follower 19 of the assembly which couples a panel 1 to the support 9 includes two pairs of rollers 21 and two shafts 23**.

The guide rails 11 can be made of profiled aluminum stock or of a suitable plastic material. Even though FIGS. 1 to 3 show that the guide rails 11 are recessed into the central portions at the underside of the support 9, it is equally possible to employ rails which are simply affixed to and extend downwardly from the underside of the support 9 or an analogous overhead panel supporting structure.

The partly cylindrical portion of the bearing 5 and the main portion 13 of the carrier 7 are provided with complementary male and female detents which serve to releasably retain the main portion 13 in the bearing in such a way that the carrier 7 can turn about the horizontal axis A. The illustrated detents include an internal groove or rib 35 in a partly cylindrical axial passage 33 of the bearing 5 and a complementary external groove or rib 15 at the periphery of the main portion 13. The detent 15 of the main portion 13 snaps into the detent 35 of the bearing 5 (or the detent of the bearing snaps into the detent of the main portion) when the main portion 13 is inserted into the bearing 5 to assume a position as shown in FIG. 2. The recesses 4 can be formed by readily available drilling or boring implements which are capable of removing material from a panel 1 starting at one side of the upper portion 3 and proceeding toward but short of the other side of such upper portion (see FIGS. 1 and 2). Each bearing 5 can be provided with two coplanar flanges **5*a* which overlie the upper side 3*a* of the respective upper portion to ensure that the bearing can be installed in its recess 4 in a predetermined angular position. Once installed, the bearing 5 is held in such predetermined angular position by one or more threaded fasteners 37 which are driven through suitable holes in the collar 6 and into the upper portion 3 of the respective panel 1**.

The shafts 23 and/or the rollers 21 and/or the runner 17 of each follower 19 are or can be made of or coated with suitable wear-resistant and friction-reducing materials. For example, at least the median portions of the shafts 23 (namely the portions which engage the surfaces bounding the second portions **25*a* of holes 25, 25*a*, 25*b* in the respective runners 17) can be provided with coats of solid (hard) nickel. The median portion of each shaft 23 can be received in the respective second portion 25*a* of the hole in the corresponding runner 17** by snap action.

FIG. 3 shows that each of the runners 17 can be provided with two cleaning implements 27 in the form of strips which are affixed to or form part of the runner and yieldably bear against the internal surfaces 29 of the respective guide rail 11. Such cleaning implements remove dust and/or other impurities from the internal surfaces 29 in front of the respective rollers 21 regardless of whether a panel 1 is pushed or pulled in a direction to the right or to the left, as viewed in FIG. 3. The illustrated flexible (and preferably resilient or elastic) strip-shaped cleaning implements 27 can be replaced by or can be used jointly with brushes (not shown) or with any other suitable devices which can sweep impurities off the internal surfaces 29 of a guide rail 11 whenever the respective panel 1 is caused to move along the guide rail 11. Elastic or resilient cleaning implements are preferred in many instances because they are more likely to remain effective for long periods of time. If the runners 17 are made of a rigid material (e.g., a plastic substance), the cleaning implements 27 (and/or analogous cleaning implements) can be bonded (e.g., with an adhesive) or otherwise permanently or detachably affixed to such runners.

FIG. 4 shows that each of the two guide rails 11 in the underside of the overhead support 9 forming part of a piece 10 of furniture or the like can be provided with an elongated slot-shaped aperture 39 which is dimensioned to permit entry of a follower 19 (including a portion of a runner 17, two shafts 23 and two pairs of rollers 21) into the groove **11*a*** of the respective rail.

Once the rollers 21 of the properly inserted follower 19 are moved away from the respective aperture 39 to engage the respective internal surfaces 29, the follower remains confined in the respective groove 11*a* even if the aperture 39 continues to remain exposed. The reason is that a follower 19 is preferably inserted into the groove 11*a* of the respective rail 11 before the main portion 13 of the carrier 7 is caused to snap into the bearing 5. Thus, if the apertures 39 of FIG. 4 are provided at a maximum distance a from the respective end of the corresponding guide rail 11, and if the distance a is less than the distance b (FIG. 1) of an upright end face la of the panel 1 from the axis A, the follower 19 including two pairs of rollers 21 cannot be returned into register with an aperture 39 as long as the main portion 13 of the respective carrier 7 remains in the adjacent bearing 5.

FIG. 1 further shows that each main portion 13 can be provided with at least one marginal cutout or notch 31 which permits insertion of the working end of a screwdriver or any other readily available suitable tool serving to facilitate extraction or expulsion of the male detent (15 or 35) from the respective female detent (35 or 15) preparatory to extraction of main portion 13 from the respective bearing 5. The diameter of the partly cylindrical passage 33 in the bearing 5 can exceed the diameter of the peripheral surface of the main portion 13 but is slightly less than the diameter of a male detent (15) surrounding the peripheral surface of the portion 13. It is clear that the peripheral surface of the main portion 13 can be provided with two or more circumferentially extending male or female detents 15 and that the axial passage 33 of the bearing 5 can communicate with two or more female detents 35 or can receive two or more male detents. The configuration of complementary detents 15, 35 is such that they permit a properly inserted main portion 13 to turn in the passage 33 of the respective bearing 5.

The mode of installing a slidable panel 1 in the opening beneath the overhead support 9 is as follows:

The upper portion 3 of the panel 1 is provided with a recess 4 for each of two or more carriers 7, normally two carriers each of which can be adjacent one upright edge face la of the respective panel 1. The recesses 4 are formed by resorting to standard tools or implements which are designed to drill blind bores or holes, and each recess 4 can extend all the way to the upper side 3*a* of the respective upper portion 3 (see FIGS. 1 and 2) to ensure that the flanges 5*a* will maintain a properly installed bearing 5 in a predetermined angular position. The collar 6 of each properly installed bearing 5 is affixed to the upper portion 3 by one or more threaded fasteners 37.

The followers 19 of the runners 17 and the fasteners 21, 23 of such followers already extend into the groove 11*a* of the respective guide rail 11 which is embedded in (i.e., recessed into) the underside of the overhead support 9 so that the main portion 13 of each carrier 7 extends downwardly beyond the slot 11*b* of the rail 11. The person in charge then manipulates the panel 1 and the bearings 5, which are already received in the respective recesses 4, in such a way that the passage 33 of each bearing 5 receives the main portion 13 of a carrier 7. The detents 15, 35 cooperate to releasably hold the main portions 13 in the respective passages 33, and the panel 1 is ready to slide in that the rollers 21 roll along the internal surfaces 29 of the guide rail 11. The preferably two carriers 7 for each panel 1 can be assembled with the respective bearings 5 one after the other. This is possible because the first properly inserted main portion 13 can turn (about the horizontal axis A) relative to the respective bearing 5 to thus ensure convenient alignment of the other bearing 5 with the main portion 13 of the adjacent carrier 7. Such sequential or stepwise attachment of the bearings 5 and panel 1 to the carries 7 is further facilitated due to the fact that the rollers 21 are received in the respective groove 11*a* with freedom of longitudinal movement (along the internal surfaces 29) as well as with at least some freedom of vertical movement (toward and away from the internal surfaces 29).

The preferably profiled guide rails 11 are receivable in complementary channels 12 which are provided in the underside of the overhead support 9 so that the guide rails 11 cannot be extracted from the channels 12 when their internal surfaces 29 bear the weight of a panel 1.

The manner in which the lower portion of a panel is guided (if it is guided at all) along the floor in a built-in closet or along the bottom wall of a kitchen cabinet, a filing cabinet or another piece 10 of furniture forms no part of the present invention.

Installation of followers 19 including the parts 17, 21, 23 into the rail 11 prior to attachment of carriers 7 to the respective bearings 5 contributes significantly to convenience of installation of a panel 1 in a time-saving manner and without the exercise of a substantial effort. Once the follower 19 is received in the groove 11*a* of the guide rail 11, it is confined to reciprocatory movement along the internal surfaces 29 and to relatively small up-and-down movements of the rollers 21 toward and away from the respective surfaces 29.

If the panel 1 is defective or must be detached from the guide rail 11 for any other reason, the person in charge inserts a suitable tool into the notch 31 of the main portion 13 to disengage, or to simplify disengagement of, complementary detents 15, 35 so that the main portion 13 can be extracted from the passage 33 of the respective bearing 5.

Figure 5:
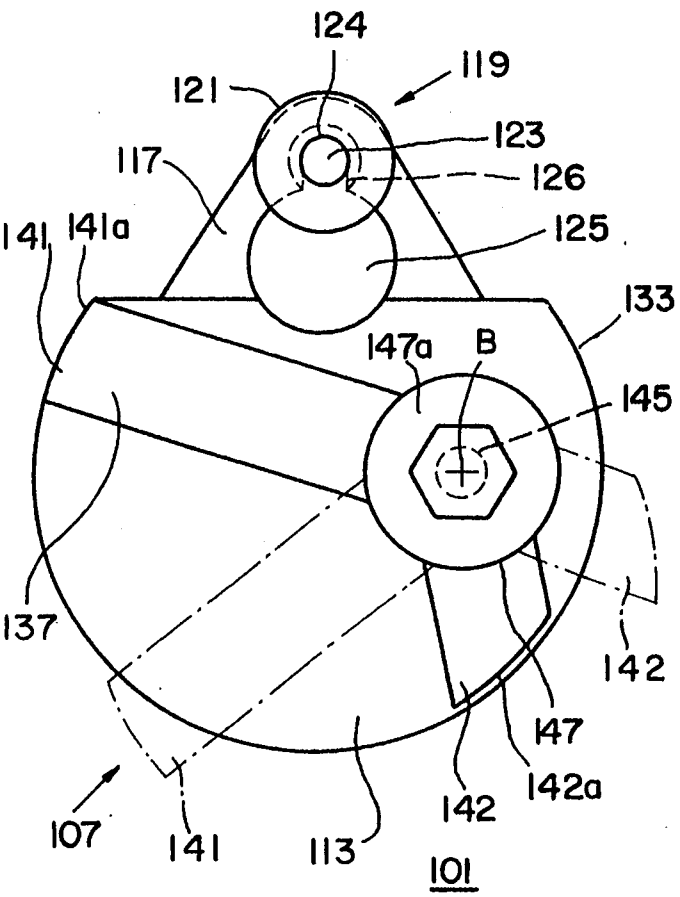
FIG. 5 is a front elevational view of a carrier forming part of a modified assembly, the operative position of an anchoring element for the carrier being indicated by broken lines.

FIG. 5 shows a modified carrier 107 which can be utilized in lieu of a carrier 7 and can be installed in a panel (not shown) without resorting to a securing device in the form of a bearing 5. Instead, the carrier 107 of FIG. 5 supports mobile securing means 137 which can be said to constitute an anchoring device and can penetrate into the surface surrounding a recess 4 in a panel or the like, e.g., in a wooden panel. The anchoring device 137 is substantially L-shaped (it can be said to resemble a boomerang) and is turnably mounted on a pivot member 145 which is eccentric to the main portion 113 of the carrier 107. The two arms or legs 141, 142 of the device 137 respectively have cutting edges 141*a*, 142*a* which penetrate into the material of a panel 1 when the main portion 113 is received in its recess 4 and the device 137 is caused to turn about its axis B from the solid-line position to the broken-line position of FIG. 5. The means for turning the device 137 about the axis B can include any suitable readily available tool having a working end receivable in a non-circular (e.g., hexagonal) socket 147 in an enlarged portion 147*a* of the device 137 at the junction of its legs 141,142. The socket 147 can be provided in addition to or in lieu of external facets (not shown) at the periphery of the enlarged portion 147*a*.

The runner 117 of the carrier 107 which is shown in FIG. 5 carries a follower 119 including a single pair of rollers 121 mounted on a common shaft 123. The runner 117 has a hole including a first or main portion 125 for the passage of one of the rolls 121, a second portion 125*a* which snugly receives the median portion of the shaft 123, and a third portion or neck portion 125*b* which establishes communication between the portions 125, 125*a* and permits sidewise movements of the median portion of the shaft 123 from the portion 125*a* into the portion 125 or in the opposite direction. The width of the neck portion 125*b* can be slightly less than the diameter of the median portion of the shaft 123 (between the rollers 121) so that the shaft 123 must be forced to move sideways from the portion 125*a* into the portion 125 or from the portion 125 into the portion 125*a* of the hole in the runner 117 of the carrier 107.

The dimensions of the anchoring device 137 are selected in such a way that its legs 141, 142 do not extend beyond the outlines of the main portion 113 in the solid-line position of the device 137 but that the free ends of the cutting edges 141*a*, 142*a* of the legs (each of these legs can be said to constitute a knife) extend radially outwardly of and beyond the periphery of the main portion 113 when the device 137 is turned about the axis B to assume the broken-line position of FIG. 5. The polygonal socket 147 in the enlarged portion 147*a* of the illustrated anchoring device 137 can be replaced with a slot for reception of the working end of a simple screwdriver without departing from the spirit of the invention.

The anchoring device 137 can be replaced with other (e.g., simpler) means for securing the main portion 113 of the carrier 107 to the upper portion 3 of a panel 1. For example, the main portion 113 can be provided with a centrally located hole or with two or more eccentric holes for the shanks of suitable threaded or other fasteners which are used to secure the main portion to the portion 1*b* of a panel 1 of the type shown in FIG. 2. Still further, the carrier 107 (which includes a follower 119 with a single pair of rollers 121) can be mounted in a bearing 5 of the type shown in FIGS. 1 and 2. Moreover, an anchoring device 137 or an analogous anchoring device can be provided in addition to a bearing 5.

Figure 7:
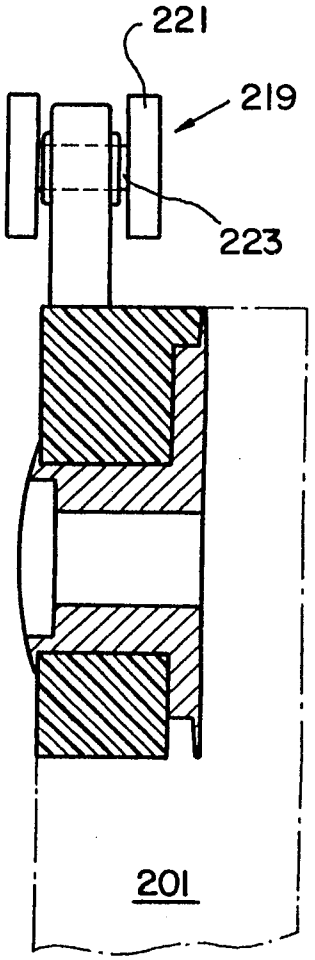
FIG. 7 is a sectional view substantially as seen in the direction of arrows from the line VII—VII in FIG. 1, a portion of the slidable panel being indicated by phantom lines.
Figure 6:
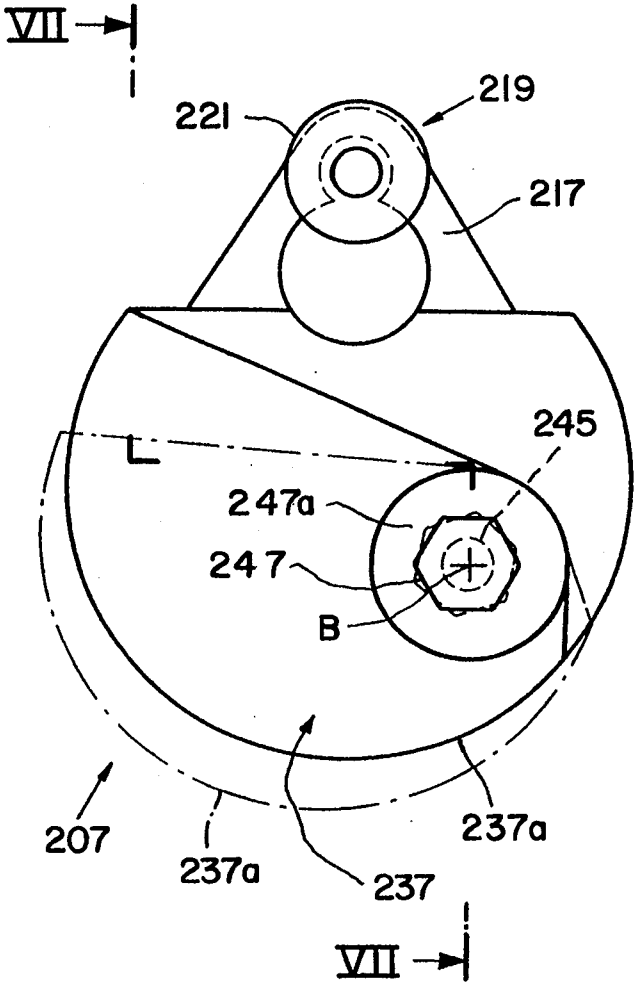
FIG. 6 is a similar front elevational view of a carrier having modified anchoring means.

FIG. 6 and 7 illustrate a carrier 207 which differs from the carrier 107 of FIG. 5 mainly in that the securing means comprises a substantially segment-shaped anchoring device 237 with an arcuate cutting edge 237*a* which penetrates into the material of a panel 201 when the device 237 is turned about the axis B from the solid-line position (in which the cutting edge 237*a* does not extend beyond the outline of the main portion 213) and the broken-line position of FIG. 6. The axis B is eccentric to the axis of the main portion 213, and the latter has a runner 217 for a follower 219 including a single pair of rollers 221 and a shaft 223. The manner in which the shaft 223 can be installed in the runner 217 is or can be the same as described with reference to FIG. 5. The device 237 is provided with a boss 247*a* which is coaxial with a pivot member 245 and is provided with a polygonal socket 247 for a suitable tool (not shown) serving to turn the device 237 about the axis B.

Figure 8:
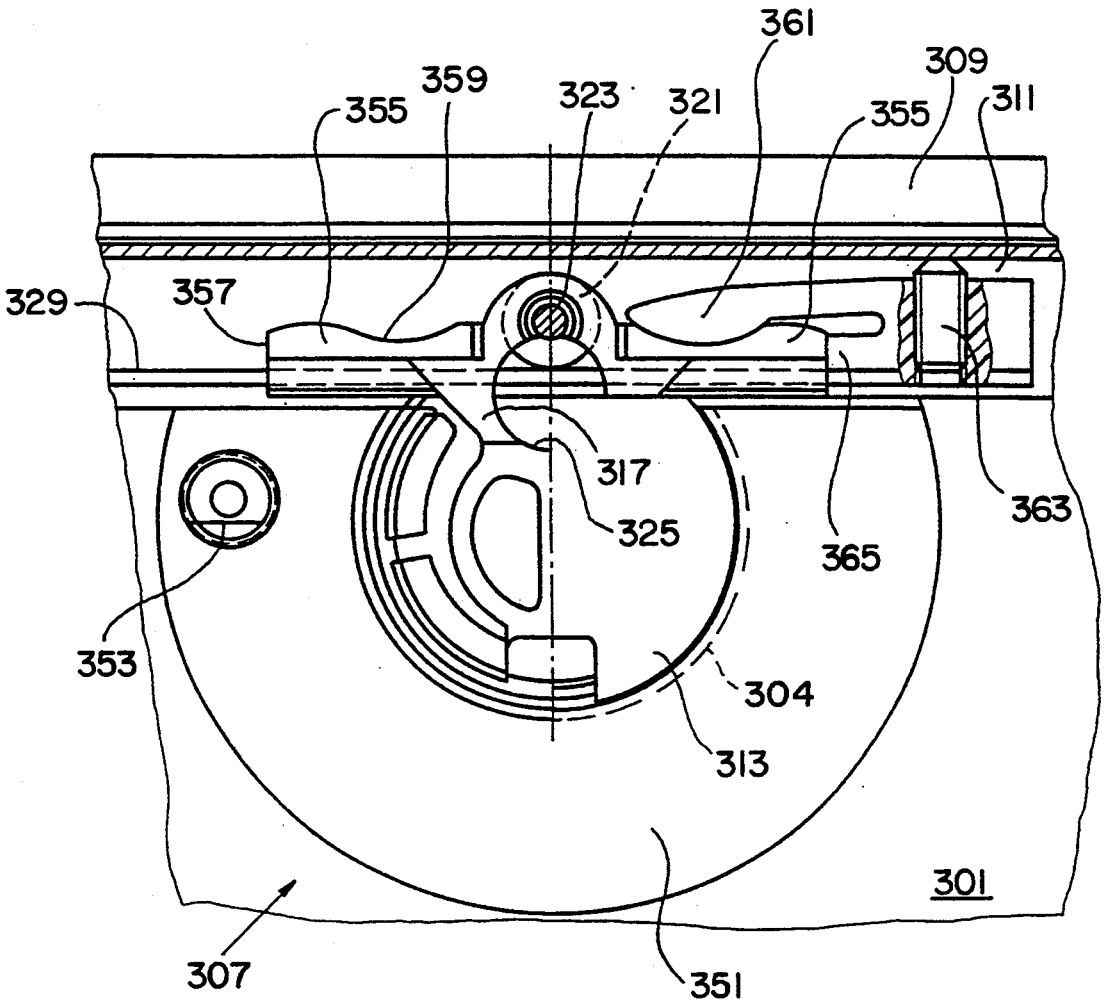
FIG. 8 is a partly elevational and partly vertical sectional view of a further assembly.

FIG. 8 illustrates a portion of a further coupling assembly wherein the carrier 307 is provided with a collar 351 secured to one side of a panel 301 by a threaded fastener 353. The main portion 313 of the carrier 307 is or can be received in a recess 304 which extends from one side toward but short of the other side of the upper portion of the panel 301, for example, in a manner as shown for the recesses 4 in FIG. 2. The recess 304 can further serve to receive a bearing (not shown) corresponding to the bearing 5 and serving to receive the main portion 313 of the carrier 307. The fastener 353 is then omitted, or is detached at least during insertion of main portion 313 into a bearing, because the main portion 313 is preferably rotatable in its bearing.

The runner 317 of the carrier 307 supports a follower including a single pair of rollers 321 which track the internal surfaces 329 of a guide rail 311 in the overhead support 309. The rollers 321 are mounted on a common shaft 323 which is installed in the runner 317 in the same way as described in connection with the shaft 123 and runner 117 of FIG. 5. FIG. 8 shows the main or first portion 325 of the hole in the runner 317.

The runner 317 is provided with two substantially wing-like extensions or arms 355 which extend in parallelism with the elongated guide rail 311 and the end faces 357 of which constitute abutments engageable with stops 365 which are provided on the guide rail 311 or on the overhead support 309 to arrest the panel 301 in two predetermined end positions. FIG. 8 shows the abutment or end face 357 on the right-hand arm 355 of the runner 317 in engagement with the illustrated stop 365 which thus maintains the panel 301 in one of its two end positions (e.g., the fully open or the fully closed position). The illustrated stop 365 forms part of a finger-like resilient catch 361 serving to releasably hold the carrier 307 (and hence the panel 301) in the corresponding end position. The catch 361 cooperates with an undulate cam 359 of the adjacent arm 355 to releasably hold the panel 301 in the illustrated end position, and this catch is affixed to the respective end portion of the guide rail 311 and/or to the overhead support 309 by one or more threaded connectors 363. The catch 361 can be rigid or substantially rigid if the cams 355 of the runner 317 are made of or are coated with a suitable elastomeric material.

The configuration of the abutments 357 and stops 365 (of which only one can be seen in FIG. 8) is preferably such that each abutment 357 can be moved into a large-area contact with the adjacent abutment 357 in the respective end position of the panel 301. The left-hand arm 355 of the runner 317 which is shown in FIG. 8 is not put to use if the panel 301 is mounted on two coupling assemblies each of which includes a carrier 307 of the type shown in FIG. 8.

The abutments 357 and the stops 365 can be made of or can be coated with suitable noise-suppressing materials to reduce noise in response to movement of the panel 301 to the one or the other end position. An advantage of the catches 361 is that they can releasably hold the panel 301 in selected end positions, i.e., their resistance to disengagement from the respective cams 355 must be overcome if the panel 301 is to be pushed or pulled from one end position toward or all the way to the other end position. The resilient catches 361 also perform a certain damping or braking action to reduce the speed of the panel 301 during the last stage of its movement toward the one or the other end position; at such time, one of the resilient catches 361 slides along the undulate surface of the oncoming cam 359.

An important advantage of the improved coupling assembly is that it occupies a small amount of space between an overhead support and a panel. This is due to the fact that a carrier with one or more pairs of relatively small rollers can be reliably installed in a relatively shallow guide rail to thus ensure predictable reciprocatory movements of one or more lightweight or heavy panels relative to the overhead support. This, the size of the opening which receives a panel beneath an overhead support need not be reduced for the express purpose of installing the improved coupling assembly.

Another important advantage of the improved coupling assembly is that the weight of a lightweight or relatively heavy panel can be borne by a rather large number of rollers (preferably not less than four) which renders it possible to provide each follower with rollers having small diameters, i.e., with rollers which can be readily installed in a guide rail having a relatively shallow groove (such as the grooves 11*a* of the guide rails 11 shown in FIGS. 1 to 4). The possibility of utilizing small-diameter rollers renders it advisable to install the guide rail or guide rails in relatively thin overhead supports, e.g., in plate-like supports having a thickness not exceeding the standard thickness of approximately 16 mm. Such overhead supports can be made of commercially available panels of plywood or the like.

The bearings 5 exhibit the advantage that they permit the respective carriers 7 to turn relative to the upper portions 3 of the panels 1. On the other hand, the anchoring devices 137, 237 exhibit the advantage that the bearings 5 or analogous constituents of the improved coupling assembly can be omitted. The anchoring devices 137,237 or analogous securing means exhibit the additional advantage that a carrier (such as 107 or 207) can be installed in a panel (such as 201) with little loss in time; all that is necessary is to drill into the panel a recess preferably resembling a portion of a blind bore and serving to receive the main portion 113 or 213 of the carrier.

The provision of followers of the type shown in FIGS. 1 to 4 exhibits the advantage that the loads can be uniformly distributed among two or more pairs of rollers for each carrier. This is due to the fact that each carrier 7 can turn about the horizontal axis A during and subsequent to installation in the respective bearings 5, and that the axes A of main portions 13 of the carriers 7 are parallel to the axes of the respective shafts 23.

The recesses (such as 4 or 304) can be provided by resorting to available implements, e.g., implements of the type used by carpenters and/or other artisans to drill blind bores or holes in panels or plates of wood or the like. Blind bores or holes of such character must be drilled for installation of so-called cupped hinges or the like.

Since the component parts of the improved coupling assembly do not or need not extend beyond the lateral surfaces of the panels, pairs of such panels (see FIGS. 1 and 2) or sets of three or more panels can be installed in immediate or close proximity to each other, i.e., in two parallel planes which are close to one another.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An assembly for movably coupling an upper portion of a panel in suspended position to an elongated guide rail disposed in an overhead support and having an elongated groove and an elongated slot affording access to the groove from below, comprising a carrier; means for securing said carrier to the upper portion of the panel, said securing means comprising a bearing receivable in a recess of the upper portion of the panel and said carrier being turnable about a predetermined axis in actual use of the assembly; a runner extending from and secured to said carrier and including a portion arranged to extend into the groove from below through the slot of the guide rail; a rotary follower mounted on said runner and receivable in the guide rail of the support, said follower including at least one pair of rollers mounted on said portion and receivable in the groove of the guide rail and said carrier and said bearing have complementary detents including means for releasably but turnably retaining said carrier in said bearing.

2. The assembly of claim 1, wherein said follower comprises a plurality of pairs of coaxial rollers.

3. The assembly of claim 1, wherein said rollers of said at least one pair of rollers are rotatable about axes which are at least substantially parallel to said predetermined axis.

4. The assembly of claim 1, wherein said follower further includes and a shaft for said at least one pair of rollers, said runner having a through hole including a first portion dimensioned to permit passage of one roller of said at least one pair of rollers and a second portion dimensioned to snugly receive the shaft between the rollers of said at least one pair of rollers and communicating with said first portion.

5. The assembly of claim 1, wherein said retaining means comprises at least one tongue on one of said carrier and bearing and at least one groove arranged to receive said at least one tongue and provided in the other of said carrier and bearing.

6. The assembly of claim 1, wherein said securing means further includes a collar arranged to overlie the panel adjacent the recess for said bearing.

7. The assembly of claim 6, further comprising means for fastening said collar to the panel.

8. The assembly of claim 1, further comprising at least one cleaning implement provided on said runner to sweep foreign matter off the rail in response to movement of the follower within and longitudinally of the rail.

9. The assembly of claim 1, for movably coupling a panel to a guide rail having two end portions and a stop at least at one of the end portions, wherein said runner includes at least one abutment arranged to impinge upon and to be arrested by the stop in response to movement of the runner to a predetermined position relative to the rail.

10. The assembly of claim 1, wherein said securing means further comprises means for facilitating separation of said carrier from said bearing.

11. An assembly for movably coupling an upper portion of a panel in suspended position to an elongated guide rail in an overhead support, comprising a carrier receivable in a recess of the panel; means for securing said carrier to the upper portion of the panel, said securing means including substantially L-shaped anchoring means for anchoring said carrier in the panel, said anchoring means being movably secured to said carrier and having at least one cutting edge arranged to penetrate into the panel in response to movement relative to said carrier; a runner extending from and secured to said carrier; and a rotary follower mounted on said runner and receivable in the guide rail of the support.

12. The assembly of claim 11, wherein said anchoring means is substantially segment-shaped.

13. An assembly for movably coupling an upper portion of a panel in suspended position to an elongated guide rail provided in an overhead support and having two end portions and a stop at least at one of the end portions, comprising a carrier; means for securing said carrier to the upper portion of the panel; a runner extending from and secured to said carrier, said runner including at least one arm arranged to extend in substantial parallelism with the guide rail, and at least one abutment provided on said at least one arm and arranged to impinge upon and to be arrested by the stop in response to movement of the runner to a predetermined position relative to the rail; and a rotary follower mounted on said runner and receivable in the guide rail of the support.

14. The assembly of claim 13, wherein said arm includes a cam and further comprising a catch connectable to the support to engage said cam and to thus releasably hold said runner in a predetermined position relative to the guide rail.

15. An assembly for movably coupling an upper portion of a panel in suspended position to an elongated guide rail in an overhead support, comprising a carrier; means for securing said carrier to the upper portion of the panel; a runner extending from and secured to said carrier; a rotary follower mounted on said runner and receivable in the guide rail of the support; and a catch connectable to the support to releasably engage and hold said runner in response to movement of the panel and carrier to a predetermined position relative to the guide rail.

16. An assembly for movably coupling an upper portion of a panel in suspended position to an elongated guide rail in an overhead support, comprising a carrier; means for securing said carrier to the upper portion of the panel, said securing means comprising a bearing receivable in a recess of the upper portion of the panel and said carrier being turnable in said bearing about a predetermined axis in actual use of the assembly; a runner extending from and secured to said carrier; a rotary follower mounted on said runner and receivable in the guide rail of the support, said follower including at least one pair of coaxial rollers and a shaft for said at least one pair of rollers, said runner having a through hole including a first portion dimensioned to permit passage of one roller of said at least one pair of rollers and a second portion dimensioned to snugly receive the shaft between the rollers of said at least one pair of rollers and communicating with said first portion and said carrier and said bearing have complementary detents including means for releasably but turnably retaining said carrier in said bearing.

17. The assembly of claim 16 for movably coupling a panel to a guide rail having an elongated groove and an elongated slot affording access to the groove from below, wherein said runner includes a portion arranged to extend into the groove from below through the slot of the guide rail, said rollers of said at least one pair of rollers being mounted on said portion and being receivable in the groove of the guide rail.

18. The assembly of claim 16, wherein said hole further includes a neck portion connecting said first and second portions and having a width sufficient to permit sidewise movements of said shaft between said first and second portions.

19. An assembly for movably coupling an upper portion of a panel in suspended position to an elongated guide rail in an overhead support, comprising a carrier; means for securing said carrier to the upper portion of the panel, said securing means comprising a bearing receivable in a recess of the upper portion of the panel and said carrier being turnable in said bearing about a predetermined axis in actual use of the assembly; a runner extending from and secured to said carrier; a rotary follower mounted on said runner and receivable in the guide rail of the support; and at least one cleaning implement provided on said runner to sweep foreign matter off the rail in response to movement of the follower within and longitudinally of the rail.

20. An assembly for movably coupling an upper portion of a panel in suspended position to an elongated guide rail disposed in an overhead support and having two end portions and a stop at least at one of the end portions, comprising a carrier; means for securing said carrier to the upper portion of the panel, said securing means comprising a bearing receivable in a recess of the upper portion of the panel and said carrier being turnable in said bearing about a predetermined axis in actual use of the assembly; a runner extending from and secured to said carrier and including at least one abutment arranged to impinge upon and to be arrested by the stop in response to movement of the runner to a predetermined position relative to the rail; and a rotary follower mounted on said runner and receivable in the guide rail of the support.

* * * * *